US005641421A

United States Patent [19]

Manov et al.

[11] Patent Number: 5,641,421

[45] Date of Patent: Jun. 24, 1997

[54] AMORPHOUS METALLIC ALLOY ELECTRICAL HEATER SYSTEMS

[76] Inventors: Vladimir Manov, Jores 6A-28, Haifa; Eliezer Adar, Sede Warburg, Shikun Banim 18, 44935; Mark Geller, 11/5 Alon St., Kadima; Evgeni Sorkine, Tagore St. 30, Tel-Aviv 69203; Iosef Margolin, Silver 29/2, Haifa, all of Israel

[21] Appl. No.: 711,973

[22] Filed: Sep. 10, 1996

Related U.S. Application Data

[63] Continuation of Ser. No. 292,685, Aug. 18, 1994, abandoned.

[51] Int. Cl.[6] ..... H05B 3/00; H05B 1/02

[52] U.S. Cl. ..... 219/553; 219/549; 338/254; 338/280; 338/308; 392/480; 392/488; 392/435; 392/385; 148/403; 148/561; 29/611

[58] Field of Search ..... 219/553, 552, 219/549, 548, 543, 544, 535, 520, 505; 338/254, 255, 262, 275, 280, 308, 309, 22 R, 225 D; 420/121, 463, 104; 148/403, 561; 29/610.1, 611, 620; 392/479, 432–435, 436–440, 407, 489, 480, 488, 385

[56] References Cited

U.S. PATENT DOCUMENTS

| | | | |
|---|---|---|---|
| 1,385,740 | 7/1921 | Armstrong | 219/553 |
| 3,286,078 | 11/1966 | Hynes | 392/489 |
| 4,064,757 | 12/1977 | Hasegawa . | |
| 4,484,061 | 11/1984 | Zelinka et al. | 392/480 |
| 4,581,081 | 4/1986 | Kroeger et al. . | |
| 4,717,812 | 1/1988 | Makita | 219/528 |
| 4,769,094 | 9/1988 | Park et al. | 148/403 |

(List continued on next page.)

FOREIGN PATENT DOCUMENTS

| | | | |
|---|---|---|---|
| 51-15194 | 2/1976 | Japan . | |
| 2-47243 | 2/1990 | Japan | 606/27 |
| 2-112192 | 4/1990 | Japan . | |
| 768851 | 10/1980 | U.S.S.R. | 148/403 |

OTHER PUBLICATIONS

Lovas, A. et al, "Casting of Ferromagnetic Amorphous Ribbons for Electronic and Electrotechnical Applications", Philosophical Magazine B, 1990, V. 61, No. 4, pp. 549–565.

Suryanarayana, C. et al, "Mechanical, Chemical, and Electrical Applications of Rapidly Solidified Alloys", from Rapidly Solidified Alloys: Processes, Structures, Properties, Appl., ed. Liebermann, 1993.

Warlimont, H., "Metallic Glasses", Inst. of Physics, 1980.

V.P. Manov, et al., "The Influence of Quenching Temperature on the Structure and Properties of Amorophous Alloys," Material Science and Engineering 535–5440 (1991).

*Primary Examiner*—John A. Jeffery
*Attorney, Agent, or Firm*—Loeb & Loeb LLP

[57] ABSTRACT

An electrical heating system uses heating elements made of ribbons of amorphous metallic alloys. The heating elements have a large area using long and wide ribbons, to achieve good heat transfer to the surroundings, that is low thermal resistance. The area of the heating elements and thus the thermal resistance is determined according to the desired thermal power, under the constraint of a low operating temperature, that is a temperature well below the embrittlement temperature of the amorphous alloy used in the heating elements. The operating temperature is preferably kept low enough so as not to generate benzopyrene or other unhealthy or ecologically unfavorable fumes or gases. The thin ribbons with low thermal resistance also have a fast heating constant, that is the heater reaches its steady state temperature in a short time. The electrical heating system uses low cost insulation and support materials, that is materials intended for use at low temperatures only. Further cost reduction is achieved by making the heating elements of lower cost alloys, that is alloys capable of withstanding oxidation only at low temperatures. The heating elements undergo treatment using the Manov process of overheating the melted alloy to a precise temperature prior to rapid quenching, to achieve more reliable ribbons with more reproducible characteristics.

17 Claims, 7 Drawing Sheets

U.S. PATENT DOCUMENTS

| | | | |
|---|---|---|---|
| 4,789,022 | 12/1988 | Ohno . | |
| 4,870,388 | 9/1989 | Sugata et al. | 338/308 |
| 4,999,049 | 3/1991 | Balderson et al. . | |
| 5,006,421 | 4/1991 | Yang et al. | 338/308 |
| 5,055,144 | 10/1991 | Fish et al. | 148/403 |
| 5,062,146 | 10/1991 | Kagechika | 392/432 |
| 5,113,203 | 5/1992 | Takagi et al. . | |
| 5,142,308 | 8/1992 | Hasegawa et al. . | |
| 5,148,191 | 9/1992 | Hasegawa et al. . | |
| 5,306,363 | 4/1994 | Masumoto et al. | 148/403 |
| 5,370,749 | 12/1994 | Ames et al. | 420/121 |

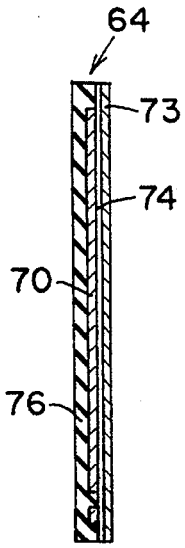
FIG. 4C
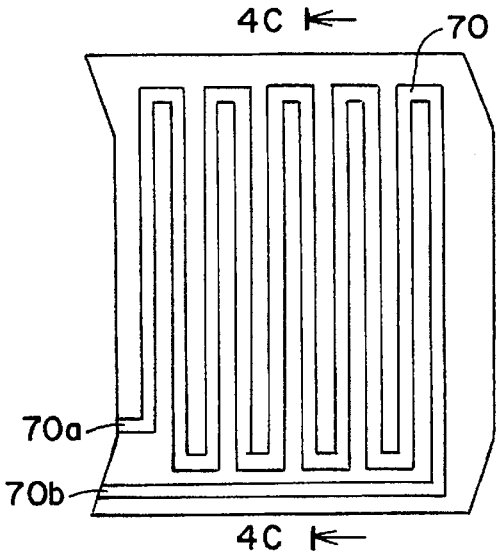
FIG. 4B
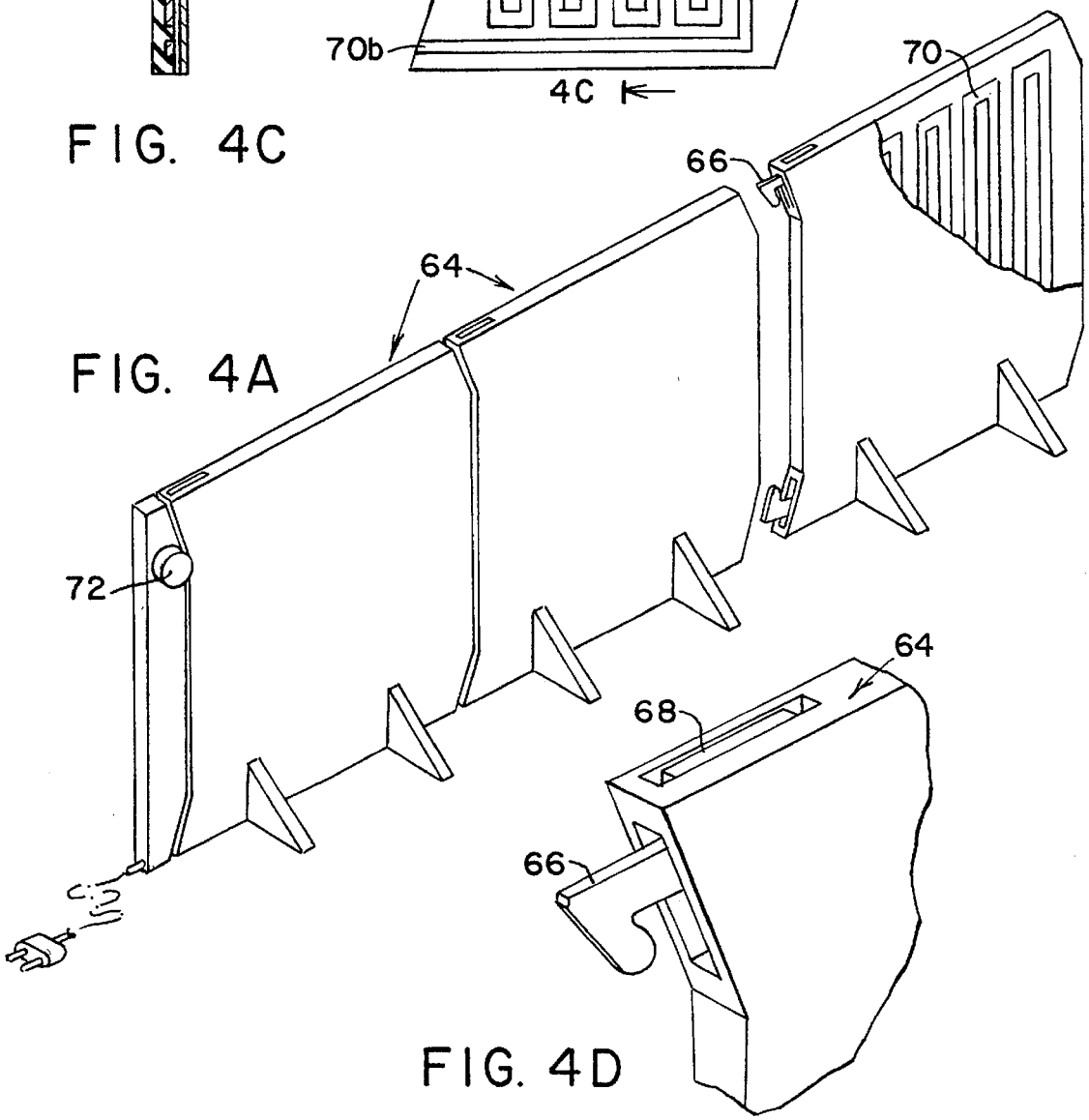
FIG. 4A
FIG. 4D

AMORPHOUS METALLIC ALLOY ELECTRICAL HEATER SYSTEMS

This is a continuation of application Ser. No. 08/292,685 filed on Aug. 18, 1994, now abandoned.

BACKGROUND OF THE INVENTION

This invention relates to electrical heater systems, and more particularly to such systems in which the heating elements are thin ribbons of amorphous metallic alloys that are operated at low and moderate temperatures.

Electrical heating systems are used in numerous consumer and industrial products. Typical are hair dryers and space heaters. Most present-day electrical heating systems consist of a wire, sometimes in the form of a closely wound coil, wrapped around supports for heating the surrounding air. In some cases, such as a hair dryer, a fan is provided for forcing air movement, but in other cases convection currents are relied upon to control air movement. The required resistance of a heating element is readily determined. The power input is equal to the square of the voltage across the heating element, divided by the element's resistance. Since the full line voltage is usually applied across the heating element and the desired power is known (limited by the maximum current which can be drawn), the required resistance can be calculated.

According to the present invention, there is provided an electrical heating element made of a ribbon of amorphous metallic alloy, and an electrical heating system including these heating elements.

According to one aspect of the present invention, the heating elements are made of an amorphous metallic ribbon.

According to a second aspect of the present invention, the heating elements have a new structure and operation: the novel structure includes a large area formed by long and wide ribbons, to achieve good heat transfer to the surroundings, that is lower thermal resistance to surroundings.

The area of the heating elements and thus the thermal resistance is determined according to the desired thermal power, under the constraint of a low operating temperature, that is a temperature well below the embrittlement temperature of the amorphous alloy in use.

Thus new operating conditions are achieved, of low temperature, even for large radiated heat power. An additional novel property: fast heating constant, that is heater reaches its steady state temperature in less time.

According to a third aspect of the present invention, the heating element ribbons are manufactured using the process developed by V. Manor, that is overheating the melted (liquid) alloy before rapid quenching, to achieve more reliable heater elements with more reproducible properties.

According to a fourth aspect of the present invention, the structure of the heating elements is such as to keep the operating temperature still lower, so as not to generate benzopyrene or other unhealthy or ecologically unfavorable fumes or gases.

According to a fifth aspect of the present invention, the heating elements use lower cost alloys, that is alloys capable of withstanding oxidation only at low temperatures.

According to a sixth aspect of the invention, the electrical heating system further uses low cost insulation and support materials, that is materials intended for use at low temperatures only.

Further objects, features and advantages of the present invention will become apparent upon consideration of the following detailed description in conjunction with the drawings.

DESCRIPTION OF THE DRAWINGS

FIGS. 4A–4D depict a space heater constructed in accordance with the principles of our invention, with FIG. 4A being a perspective view of three modules which comprise the heater, FIG. 4B showing the pattern of the ribbon heating element on one of the modules, FIG. 4C being a sectional view through the line 4C–4C of FIG. 4B, and FIG. 4D showing in greater detail a latch mechanism for connecting adjacent panels;

DETAILED DESCRIPTION

Figure 1B:
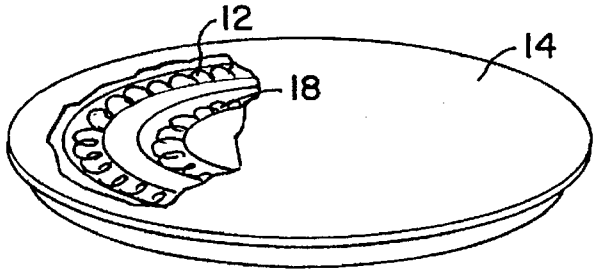
FIG. 1B PRIOR ART
FIGS. 1B–1D are examples of prior art uses of such a coil, FIG. 1B showing a stove burner, FIG. 1C showing a space heater, and FIG. 1D showing a hair dryer.

A preferred embodiment of the present invention will now be described by way of example and with reference to the accompanying drawings. The resistance of the heating element is calculated using methods well known in the art, from the desired electrical power and the applied voltage.

Knowing the required resistance, however, is only the beginning of the design process. The function of the heater is to transfer the heat generated in the resistance element to the surrounding medium. It is a well known principle of thermodynamics that heat flows only from objects at higher temperatures to objects at lower temperatures, and thus the temperature of the heating element must be higher than the temperature desired for the medium to be heated. It is also well known that the heat flow is affected by the temperature difference and by the surface area of the heating element. The higher the temperature of the heating element, the greater the heat transfer from the heating element to the surrounding medium. Similarly, the larger the surface area of the heating element, the greater the heat transfer.

"Thermal resistance" is the term used in the art to define the heat transfer property of a material or between a body and the ambient; it is defined as the temperature difference resulting from the flow of 1 Watt of thermal power.

A lower thermal resistance is achieved by increasing the area of the heating elements. Thus, increasing the area of the heating elements results in a capability to transfer a desired thermal power to the surroundings, while the heating element is kept at a lower temperature.

It is well known that the electrical resistance is proportional to the length of a wire or ribbon, and inversely proportional to its cross- sectional area. Thus, for a ribbon of constant thickness, the same electrical resistance can be achieved by using either a short and narrow ribbon, or a wide and long ribbon.

As the surface area of a wire heating element increases with the diameter of the wire, the resistance per unit length decreases. Since the total resistance is determined by the power calculation, there are practical limits to how large the surface area of the heating element may be. And the smaller the surface area, the higher the operating temperature necessary to transfer the desired amount of heat from the heating element to the surrounding medium. Thus a heating element should not only have good anticorrosion properties for long life, and sufficient electrical resistivity to allow optimization of the surface area, but it should also be capable of operation at high temperatures for sustained periods. Commonly used heating elements for high-temperature heaters are made of $Ni_{80}Cr_{20}$ alloy, Kanthal and Fechralloy, and their typical operating temperatures are 900°–1500° C. Heating elements for moderate-temperature heaters are typically made of Manganin and Constantan, and while the operating temperatures are lower, they are still usually in the order of many hundreds of degrees C. The materials mentioned have relatively high electrical resistivities. The range of electrical resistivities for the first group is about $1.0–1.3*10^{-6}$ ohm*m, and the materials of the second group have electrical resistivities in the range of $0.28–0.52*10^{-6}$ ohm*m. It is well known in the art that the higher the temperature of a material, the more is that material susceptible to oxidation. In practical use, oxidation results in rust formation and degradation of the heating elements. To allow operation at high temperatures, the heating elements have to be made of expensive metals, capable of withstanding oxidation at high temperatures.

While conventional heating elements can withstand high temperatures, they are expensive. Moreover, because of the high operating temperature required in a conventional heater, the rest of the heater is more expensive than it otherwise need be. For example, thermal insulation is required, as well as the use of materials which can withstand high temperatures. High-grade electrical insulation is also needed since the insulation properties of most materials become poorer at higher temperatures. There are also ecological problems which arise from high operating temperatures. For example, the odors that are often associated with space heaters and hair dryers arise from the burning of organic dust particles in the air as a result of the high temperatures. (Formation of benzopyrene, for example, starts at a temperature of about 180° C.)

The most widely used form of heating element is that of wire. Wires are flexible and durable, and there is a wide range of wires with different diameters and of different materials to choose from. However, a wire provides the smallest ratio of surface area to volume per unit length, and as discussed above a large surface area is important for high heat transfer. For this reason, consideration has been given to using thin ribbons or foils as heating elements rather than wires. A thin ribbon, for example, has a much larger ratio of surface area to volume per unit length, and theoretically a ribbon heating element of the same resistance as a wire element can be operated at a lower temperature and yet control the same heat transfer. Unfortunately, the process of making thin ribbons or foils is very expensive. The latter involves numerous steps, including etching of a resistive material carried on a substrate. The former involves repeated rolling of a wire. The comparative prices of foils and films obtained by this rolling method are represented in the following table. All prices are those of Goodfellow Metals Ltd., Cambridge Science Park, Cambridge CB44DJ, England.

| Material | Thickness, μ | Width, mm | Cost per gram, $ |
|---|---|---|---|
| $Ni_{80}Cr_{20}$ alloy | 20 | 150 | 27.7 |
| | 25 | 200 | 19.1 |
| | 125 | 150 | 0.79 |
| Manganin | 20 | 200 | 47 |
| | 40 | 200 | 2.1 |
| | 500 | 300 | 0.375 |
| Kanthal | 100 | 5 | 0.055 |
| Fechralloy | 25 | 50 | 10.37 |
| | 50 | 50 | 0.347 |

In the above table. Fechralloy and Kanthal are similar iron-chromium-aluminum alloys. It is apparent that costs increase significantly with ribbon thinness. (By contrast, an amorphous alloy ribbon of our invention, having a thickness of only 25 microns and a width of 50 mm, costs about $0.025 per gram to produce.) Ribbons known in the art for use in heating elements use a thin and short ribbon; for example, J82-112192 repeatedly describes a 10 mm wide ribbon; our use of a 200 mm wide ribbon results in a 20 times increase in width with a 20 times required increase in length to achieve the same resistance; thus the area increases 400 times, dramatically decreasing the thermal resistance to ambient, and an about 400 times reduction in the operating temperature. This is an illustration of an extremely wide element, to be used for very high power or very low operating temperatures according to the present invention; more practical values for the element width are about 30 mm to 100 mm.

The wires, ribbons and etched foils discussed thus far have one thing in common—they are all made of crystalline metallic alloys, e.g., nickel-chromium or iron-chromium-aluminum materials. Most metals and metallic alloys assume a crystalline form. In recent years, however, attention has been paid to the fabrication of thin amorphous metallic alloy ribbons, primarily for use in magnetic applications. Amorphous ribbons have very good mechanical properties (e.g., hardness, flexibility and tensile strength), they are much cheaper to produce than crystalline ribbons of the same thickness (under 35 microns), and they are easier to work with. An example of a process for making an amorphous ribbon is disclosed in Ohno U.S. Pat. No. 4,789,022. Most often, amorphous ribbons are produced using one-stage melt spinning technology. A ribbon is formed from a melt and rapidly quenched so as to "freeze" the metal atoms before they can arrange themselves in a crystalline structure. Amorphous ribbons may be made in a wide range of widths and thicknesses. Typical widths are 1–100 mm, and typical thicknesses are 20–35 microns. Such amorphous ribbons have electrical resistivities which can go as high as $20*10^{-6}$ ohm*m, although typically their resistivities are in the range of $1–5*10^{-6}$ ohm*m, still equal to or higher than the resistivities of crystalline ribbons.

Despite all of the activity in amorphous metallic ribbons, such materials have just not been used as heating elements. It is believed that there are two reasons for this. The first is that the properties of amorphous metallic ribbons are not generally reproducible in the sense that the material characteristics are not consistent from one batch to the next, and even from the start of any single ribbon to its end. Obviously, if the electrical resistivity varies from ribbon section to ribbon section, a different length piece will have to be cut for any given heater and that certainly complicates the manufacturing process. (Amorphous ribbons exhibit a very low temperature resistance coefficient, i.e., the resistivity does not vary with temperature, and this is one of the advantages they offer. What is meant by a varying resistivity is that the constant-value resistivity of one ribbon section is often different from the constant-value resistivity of another ribbon section.) In this regard, however, it is possible to make ribbon with reproducible characteristics. In an article by Manov et al. entitled "The Influence Of Quenching Temperature On The Structure And Properties Of Amorphous Alloys," published in Materials Science and Engineering, A133 (1991) 535–540, an "overheating" technique is disclosed. By overheating the melt and then lowering the temperature before actually forming an amorphous metallic ribbon from it, it is possible to produce a ribbon with improved characteristics, such as higher and more stable resistivity. As used herein, the term overheated metallic alloy ribbon refers to a metallic alloy ribbon made from a melt which had been overheated as described by Manov et al. Although the reproducibility of results is not mentioned, that is in fact another advantage of overheating. (The Manov et al. article provides good general background reading on amorphous ribbons.) The present invention describes the production of heating elements using the melted alloy overheating process detailed by Manov, with the unexpected benefit of achieving reliable ribbons with reproducible characteristics as detailed above; these benefits were not described in the Manov article.

Thus, until now the abovedetailed process was not known to be advantageous to heating elements made of amorphous metallic alloys.

It is believed that the more important reason amorphous metallic ribbons have not been used in heaters is that the conventional thinking of heater designers is that high-temperature heating elements must be used, and amorphous ribbons are destroyed by high temperatures. Conventional heating element materials are expensive precisely because they can indeed be operated at high temperatures. The ordinary heater designer looks for a heating element which can withstand a high operating temperature, whether that element be in the form of a wire, a ribbon or an etched foil. But if an amorphous metallic ribbon is operated at a high temperature, it not only can become brittle, it can become crystalline. The heater characteristics drastically change with such a change in structure. Amorphous materials start to become brittle and then crystalline at temperatures in the low hundreds of degrees C, and consequently amorphous materials are just not the stuff of which heating elements are traditionally made.

It is an object of our invention to provide an electric heater that can be operated at relatively moderate temperatures, thus giving rise to all of the advantages of low-temperature operation described above.

It is another object of our invention to provide an electric heater that is much less expensive than comparable prior art heating elements.

It is another object of our invention to provide heating elements that can be turned on and off repeatedly, yet which reach a steady state condition rapidly after current is first applied.

It is still another object of our invention to reduce the amount of raw material needed for the production of heating elements.

Comparison Of Amorphous And Crystalline Ribbons

One of the most important properties of a heating element is how fast it can cause the object to be heated to reach its desired steady state temperature. This is especially important in applications in which a heater is turned on and off repeatedly. As will be seen, amorphous materials offer far superior performance than crystalline materials.

The following table sets forth the resistivity ranges and approximate maximum operating temperatures of six materials. The first two are commercially available crystalline alloys, and the last four are amorphous alloys. (Moderate temperature crystalline materials are included in the table since their operating temperature ranges are comparable to those of amorphous alloys.)

| Alloy | Resistivity $10^{-6}$ ohm*m | Maximum Temperature, °C. |
|---|---|---|
| Constantan | 0.44–0.52 | 500 |
| Manganin | 0.42–0.52 | 100 |
| $Fe_{78}B_{18}Si_4$ | 1.2 | 400 |
| $Fe_{74}Co_{2.5}Cr_{7.5}B_{16}$ | 1.6 | 450 |
| $Fe_{13}Ni_{60}Cr_5Si_{10}B_{12}$ | 3.0 | 300 |
| $Al_{65}Co_{10}Ge_{25}$ | 14–18 | 400 |

It is apparent from the table that the resistivities of most amorphous alloys are much higher than those of conventional crystalline materials. However, in order to obtain a fair comparison of how fast two heating element ribbons can heat up a room, alloys of equal resistivities will be selected. $Ni_{80}Cr_{20}$ alloy has a resistivity of $1.0–1.1*10^{-6}$ ohm*m and so does an amorphous alloy made of $Fe_{78}B_{18}Si_4$. But to compare ribbons made of these two materials, physical constraints must be taken into account. $Ni_{80}Cr_{20}$ alloy crystalline ribbon is made by successive rolling operations starting with a wire. It is very difficult to produce such a crystalline ribbon with a thickness less than $10^{-4}$ m. Therefore, this will be taken as the minimum thickness for a crystalline ribbon. On the other hand, an amorphous alloy ribbon can be made with a thickness of $2*10^{-5}$ m with little difficulty, so this will be used as the thickness for the amorphous ribbon. Following is a list of additional specific amorphous alloys known in the art which can be used to produce the heater elements described in the present invention:

$Fe_{80}B_{20}$
$Fe_{40}Ni_{40}B_{15}C_1Si_4$
$Ni_{70}Si_{15}B_{15}$
$Fe_{85}B_{15}$
$Fe_{76}B_{24}$
$Ti_{48.5}Cu_{45}Ni_5Si_{1.5}$
$Al_{65}Co_{10}Ge_{25}$

The heating time constant is one of the most important characteristics of a heating element. The heating time constant $t_r$ of a heating element, that is, the time for the temperature of the object to be heated to rise up to its steady state value, can be estimated from the following formula: $t_r=Kmc/\alpha S$, where K is a proportionality constant, m is the mass of the heating element, c is its specific heat, $\alpha$ is the heat transfer coefficient between the element and the air (or other object) to be heated, and S is the surface area of the heating element. The heating time constants of a crystalline $Ni_{80}Cr_{20}$ alloy wire and an alloy ribbon element of the same material can be compared. For equal values of power (equal values of total resistance R) and heat transfer coefficient a, the heating time constants depend on the physical dimensions. The resistance R of the ribbon is equal to the resistivity multiplied by L/bh, where L is the length of the ribbon, b is its width, and h is its thickness. The resistance R of the wire is equal to the resistivity multiplied by $L/3.14r^2$, where r is radius of the wire. For equal resistances of the wire and ribbon, the ratio of the wire to ribbon heating time constants is b/3.14r. As can be seen, the wider the ribbon in comparison with the wire radius, the less the ribbon heating time constant in comparison with the wire heating time constant. The same conclusion is true for amorphous ribbons when compared with wires. In practice, the use of an amorphous ribbon as a heating element leads to a significant decrease in the heating time constant and faster heating of a room. An important advantage of ribbon use is in multiple switch on/switch off working regimes of the heating element (for example, that in a hand dryer). There is a considerable energy savings in the transient regimes when compared with heaters that use conventional heating elements.

Another important characteristic of a heating element is its heat transfer efficiency. By this is meant how much heat can be transferred from the heating element to the surrounding air for any given temperature of heating element operation. Since most conventional heating elements are in the form of a wire, comparisons will be made between crystalline wires and amorphous ribbons. In every case the length of the heating element is taken to be one meter. It is also assumed for the sake of comparison that any wire and ribbon to be compared have equal electrical resistances. Thus for any wire and ribbon that are compared, their dimensions are such that they have equal cross sections. In the following table, the first column represents the area in square millimeters of the wire whose diameter is in the second column. The third column represents the width of a comparable amorphous ribbon whose thickness is $2*10^{-5}$ m. The relative heat transfer areas in terms of area per unit of length are provided in the fourth column, for both the wire and ribbon in each row whose cross sections are equal. The heat transfer area can be computed readily from the previous dimensions.

The heat transfer is accomplished by free convection in still air. In all cases the heat transfer coefficient is assumed to be 5.6 $W/m^2*°$ C. The difference between the heating element temperature and that of the air to be heated is taken to be 100° C. The heat transfer power from the heating element is calculated using the heat-balance equation, $P=a*S*(T_f-T_a)$, where S is the heat transfer area of the heating element, $T_f$ is the final temperature of the heating element, $T_a$ is the ambient temperature of the air, and a is the heat transfer coefficient. The fifth column in the table sets forth the heat which is transferred from the heating element in each case:

| Cross section, | Wire diameter, | Ribbon width, | Heat transfer area, $m^2/m*10^{-3}$ | | POWER, W | |
|---|---|---|---|---|---|---|
| $mm^2$ | mm | mm | Wire | Ribbon | Wire | Ribbon |
| 0.0177 | 0.15 | 0.885 | 0.471 | 1.774 | 0.264 | 0.933 |
| 0.031 | 0.20 | 1.55 | .625 | 3.054 | 0.350 | 1.710 |
| 0.049 | 0.25 | 2.45 | 0.785 | 4.904 | 0.440 | 2.746 |
| 0.071 | 0.30 | 3.55 | 0.942 | 7.104 | 0.528 | 3.978 |
| 0.096 | 0.35 | 4.80 | 1.100 | 9.604 | 0.616 | 5.378 |
| 0.126 | 0.40 | 6.30 | 1.257 | 12.604 | 0.704 | 7.058 |
| 0.196 | 0.50 | 9.80 | 1.571 | 19.604 | 0.808 | 10.978 |

As can be seen from the table, the amorphous ribbon heating element is much more effective than the crystalline wire heating element because of the larger heat transfer area in every case. For the same steady state heating element temperature, much more heat is transferred to the surrounding air by a ribbon than a wire whose masses are the same. (Mass is a very important consideration because it directly affects cost.) Were a crystalline ribbon to be substituted for the wire, the heat transfer characteristics would be more comparable because of the larger area of the crystalline ribbon. However, a crystalline $Ni_{80}Cr_{20}$ alloy ribbon, for example, costs many times more than a comparable amorphous ribbon.

Figure 1D:
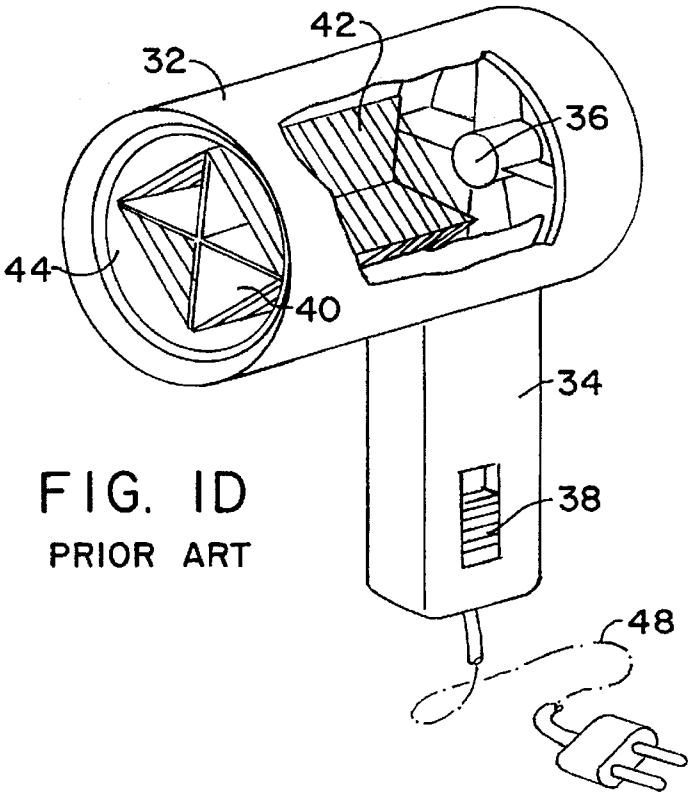
FIG. 1D PRIOR ART
Figure 1A:
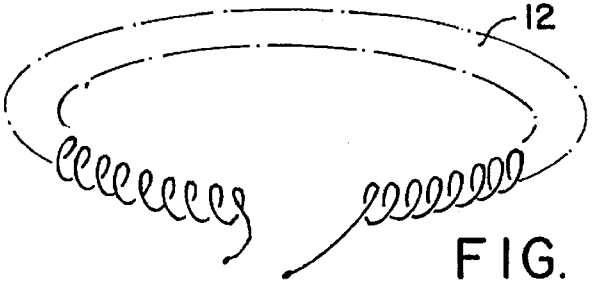
FIG. 1A PRIOR ART
FIG. 1A depicts a prior art heating coil element.

The prior art heating element 12 of FIG. 1A is a coiled nichrome (nickel-chromium) wire. The wire is crystalline in form, the natural state of a metal which is allowed to solidify gradually. FIG. 1B depicts a stove burner with the heating coil 12, together with another similar heating coil 18. The two coils are embedded in a ceramic plate 14, and appropriate electrical connections (not shown) are made to the two ends of each coil for controlling current flow.

Figure 1C:
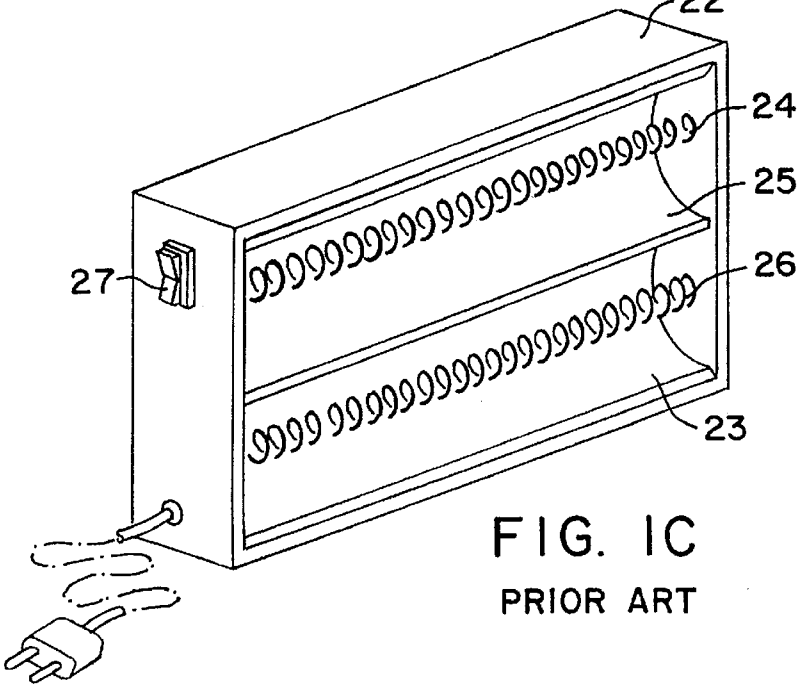
FIG. 1C PRIOR ART

FIG. 1C depicts another well-known use of prior art crystalline coils for heating purposes. The space heater of this drawing includes a case 22, two heating coils, 24, 26, two reflectors 23, 25 and a power switch 27.

Yet another example of the prior art use of a crystalline metallic wire for heating purposes is shown in FIG. 1D, a hair dryer. Case 32 and handle 34 are usually an integral plastic molded piece. Power is extended from line cord 48, through contacts on switch 38, to wire 42 which is wound around mica frame 40. The frame, which must withstand high temperatures, simply serves to support the wire heating element. The heating unit is contained within a cylindrically shaped mica insulating sleeve 44 which isolates the heating element, both electrically and thermally, from case 32. A fan 36 is at the rear of the heating element, the fan being turned by a motor (not shown) when switch 38 is turned on. The fan causes air to move past the heating element and to thus have its temperature raised. A good part of the cost of a conventional hair dryer is attributable to the heating element 42.

The remaining drawings illustrate some examples of the use of the amorphous ribbons of our invention. These examples include space heaters for replacing the prior art heater of FIG. 1C, and a hair dryer for replacing the prior art device of FIG. 1D. A new example is the use of amorphous ribbons to heat water, for example, water at the outlet of a kitchen or bathroom hot-water faucet, without requiring the use of a central water heater. These are only several of the uses of amorphous ribbons for heating purposes. Our invention is in fact broadly applicable where heating elements are required.

Figure 2A:
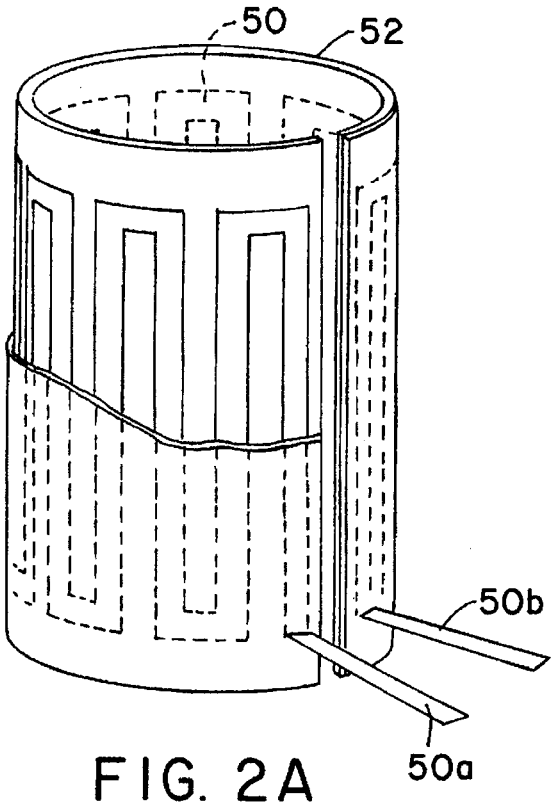
FIGS. 2A–2C depict an illustrative heating element of our invention, with FIG. 2A being a perspective view, shown partially broken away, FIG. 2B being a similar side view, and FIG. 2C being a top view.
Figure 2C:
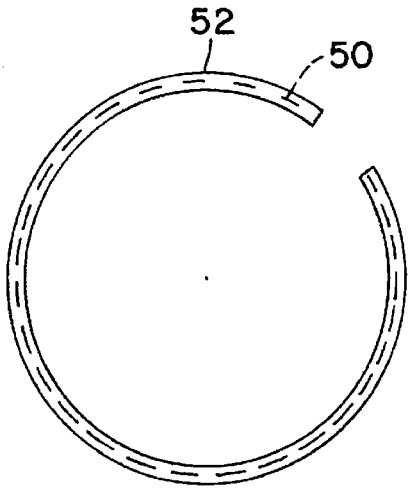
Figure 2B:
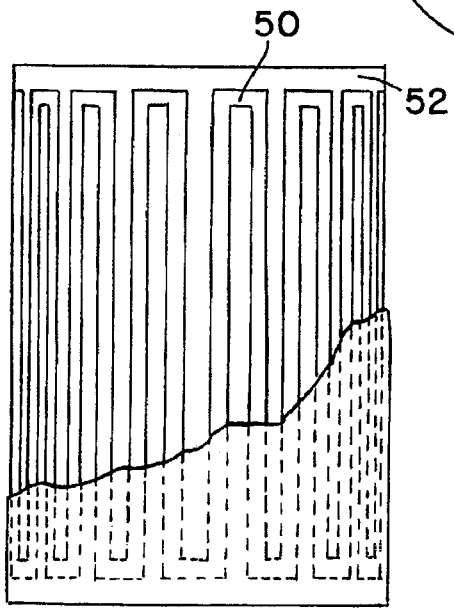

FIG. 2A is a perspective view, shown partially broken away, of a heating element constructed in accordance with the principles of our invention; FIG. 2B is a side view of the heating element, also shown partially broken away, and FIG. 2C is a top view. The heating element consists of an amorphous metallic ribbon 50 mounted between two (in this case, cylindrically-shaped) plastic sheets glued, laminated or otherwise joined together as a unit 52. Suitable plastics for use with the heating element of FIGS. 2A–2C are polystyrene and polyamide. In general, the material encasing the ribbon should have good heat conductivity and poor electrical conductivity. The ends **50*a*, 50*b*** of the ribbon are shown extending out of the heating element. The ends of the ribbon may be attached to terminal lugs, or they may be encased in a covering material to provide them with increased strength depending on the particular application involved.

Figure 3:
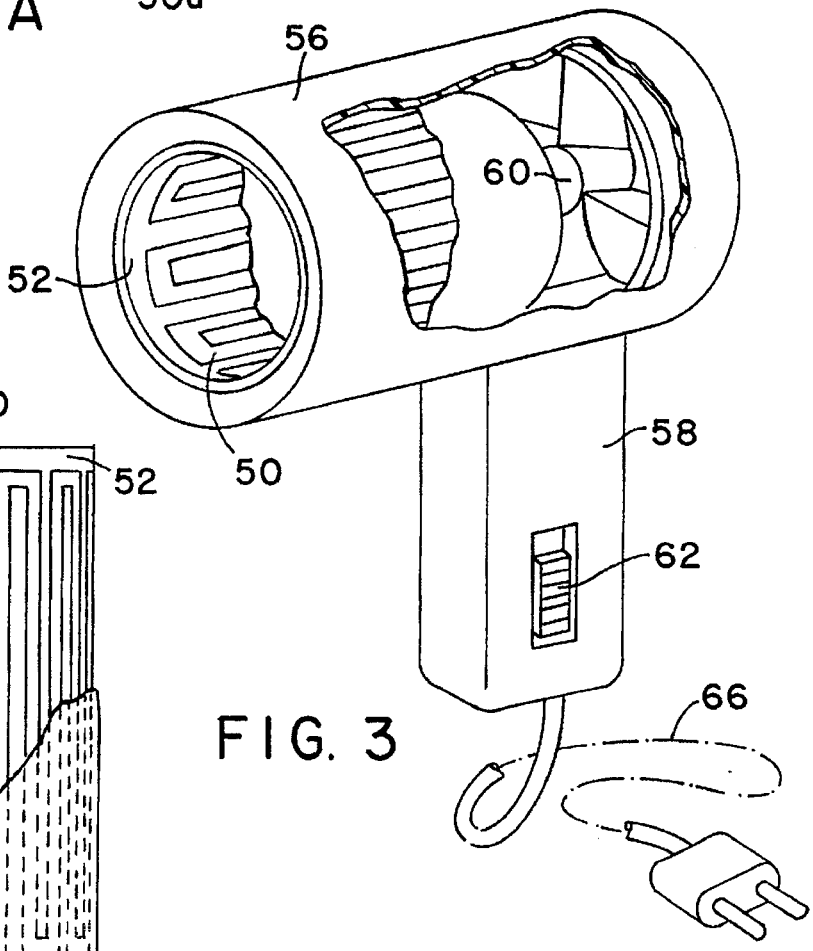
FIG. 3 is a perspective view of a hair dryer, shown partially broken away, made in accordance with the principles of our invention, utilizing the heating element of FIGS. 2A–2C.

One use for the heating element of FIGS. 2A–2C is depicted in FIG. 3, a hair dryer similar to that shown in FIG. 1D but which utilizes the heating element of the invention. Case 56 and handle 58, as in the hair dryer of the prior art, comprise an integral molded piece, with a power switch 62 in the handle controlling the flow of current from line cord 66. The switch controls the application of current to both the heating ribbon element and the motor which drives fan 60. The heating element itself, that of FIGS. 2A–2C, is placed within the case 56. There is no need for high-temperature mica supports or high-temperature insulation as in the prior art hair dryer of FIG. 1D.

The advantages of our invention can be appreciated by comparing the hair dryer of FIG. 3 with the prior art hair dryer of FIG. 1D. A typical commercial prior art hair dryer has a heating element made of crystalline Kanthal wire of 0.4 mm diameter, with a length of 486 cm. This device, when operated at 920 watts, exhibits a wire heating element temperature of approximately 600° C.

In order to compare the two hair dryers, the commercial dryer was changed only by removing its heating element and substituting for it a heating element made in accordance with our invention. The amorphous ribbon used was made of $Fe_{80}B_{20}$ material, and also operated at 920 watts. The ribbon thickness was 20 microns, its width was 5 mm, and its length was 388 cm. The operating temperature of the ribbon heating element was measured at 100° C.—six times less than the operating temperature of the commercial hair dryer heating element. The cost of the amorphous ribbon used was approximately one-half that of the wire used in the commercially available product. It will be understood that because of the lower operating temperature, it is possible to reduce the overall cost of the device still further because it is no longer necessary to use expensive, high temperature insulating materials.

The space heater of FIG. 4A consists of multiple modules 64. The pattern of the heating ribbon 70 of the rightmost module is shown most clearly in FIG. 4B. The rightmost module has a ribbon which terminates at two ends **70*a*, 70*b*, but otherwise consists of a single continuous element. Only one intermediate module is shown in FIG. 4A, and this module is similar to that of the module shown in FIG. 4B except that just as there are two open ends 70*a*, 70*b*** at the left side, there are two open ends on the right side. This is to allow intermediate modules to be connected to the two modules on either side so that no matter how many modules are combined, there is effectively one long continuous ribbon heating element.

The leftmost module includes a control knob 72 for controlling the power delivered to the heater, as well as a line cord, as shown. The control knob 72 can regulate the current flow just as in present-day heaters—our invention is concerned with the construction of the heating element, not the peripheral control mechanisms of the prior art.

In order to connect the several modules or panels to each other, they are provided with hooks 66, as shown most clearly in FIG. 4D. When a button 68 at the top of a module is depressed, the hooks separate to allow their insertion into notches (not shown) of an adjacent module; when the button is released, the hooks grab corresponding pins (not shown) so that the connection remains secure. Any standard coupling mechanism can be used, and the particular mechanism shown does not comprise an aspect of our invention.

The ribbon heating elements must be connected at two points wherever one panel mates with another. Such coupling can be effected through the hooks, or the ends of the ribbon in each panel may be terminated at contact pads, with the contact pads of one module pressing against the contact pads of the adjacent module when the modules are coupled to each other. Once again, our invention is concerned with the amorphous metallic alloy ribbons from which the heating elements are made, not standard features of coupling panels to each other, regulating current flow, and the like.

FIG. 4C depicts the cross-section of a panel. The rear of the heater panel consists of a cover 76. The amorphous ribbon 70 can be attached directly to the cover if the cover is made of electrically insulating material, or the ribbon can be embedded in electrically insulating material such as is shown in FIGS. 2A–2C. The front of the module consists of an aluminum cover 73 secured to the ribbon or ribbon laminate with a layer of silicone glue 74. The ribbon heats the aluminum plate, and it is the plate which heats the surrounding air. A heater of the type shown in FIGS. 4A–4D, but with only a single panel, was made using an amorphous ribbon heating element of $Fe_{78}B_{18}Si_4$ material. The ribbon was attached to an aluminum plate which had an area of 0.3 $m^2$. The ribbon had a thickness of 20 microns, a width of 1 cm, and a length of 10.15 m. For an operating voltage of 220 volts and a current of 2.3 amperes, i.e., when operated at a power level of about 500 watts, the surface temperature of the heater was 80° C., and the temperature of the heating element was only 150° C., far less than the operating temperature of prior art "red hot" heating coils.

Figure 5B:
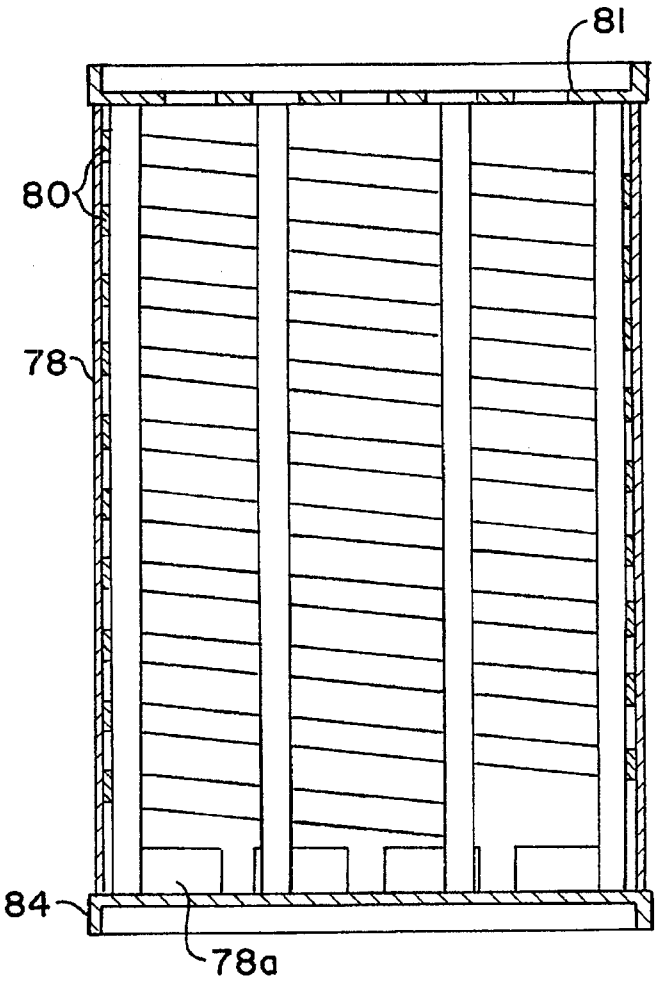
FIGS. 5A and 5B depict another form of space heater constructed in accordance with the principles of our invention, with FIG. 5A being a perspective view, shown partially broken away, and FIG. 5B being a cross-sectional view taken along line 5B—5B in FIG. 5A.
Figure 5A:
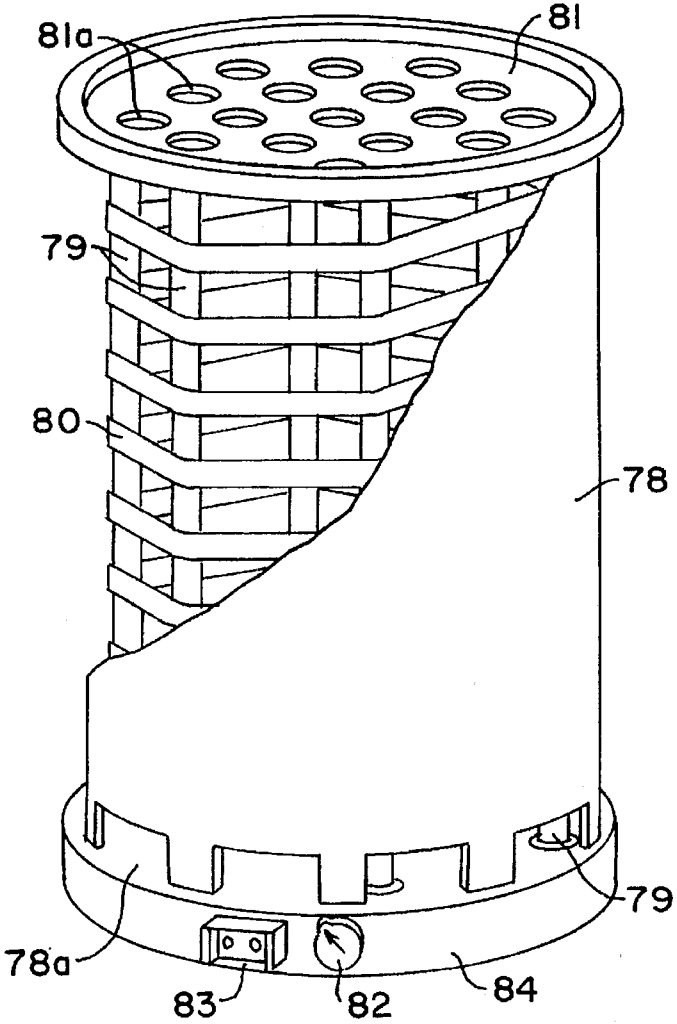

FIGS. 5A and 5B depict a complete different form of space heater, one in which the amorphous metallic ribbon is not supported by a substrate. The heater consists of a base 84, a top cover 81 which has holes **81*a*, and a radiating case 78 which surrounds the heating element but includes notches 78*a* at the bottom. The notches, together with the base 84, define holes into which air can flow. The air flows up through the heater due to convection currents and exits through holes 81*a*** at the top.

The heating mechanism itself consists of nothing more than vertically oriented insulating rods 79, around which is wound a long amorphous metallic ribbon 80. The ribbon is preferably fixed by silicone glue to the rods. The base of the heater includes a regulating knob 82 and a line cord socket 83 of conventional design. The two ends of the ribbon are extended through the current regulating mechanism to the two contacts in socket 83. The heater is the essence of simplicity and low cost.

The ribbon 80 of FIGS. 5A and 5B, in one embodiment of the invention which was constructed, was wound around six insulator rods. The ribbon, of $Fe_{78}B_{18}Si_4$ material, had a thickness of 20 microns, a width of 20 mm, and a length of 8 m. When operated at 1300 watts, the temperature of the ribbon surface did not exceed 140° C. This heater, and the 500-watt heater discussed immediately above, were operated for over 1,000 hours. In each case the amorphous ribbon was checked by X-ray diffraction, and no changes in ribbon structure were found.

Figure 6B:
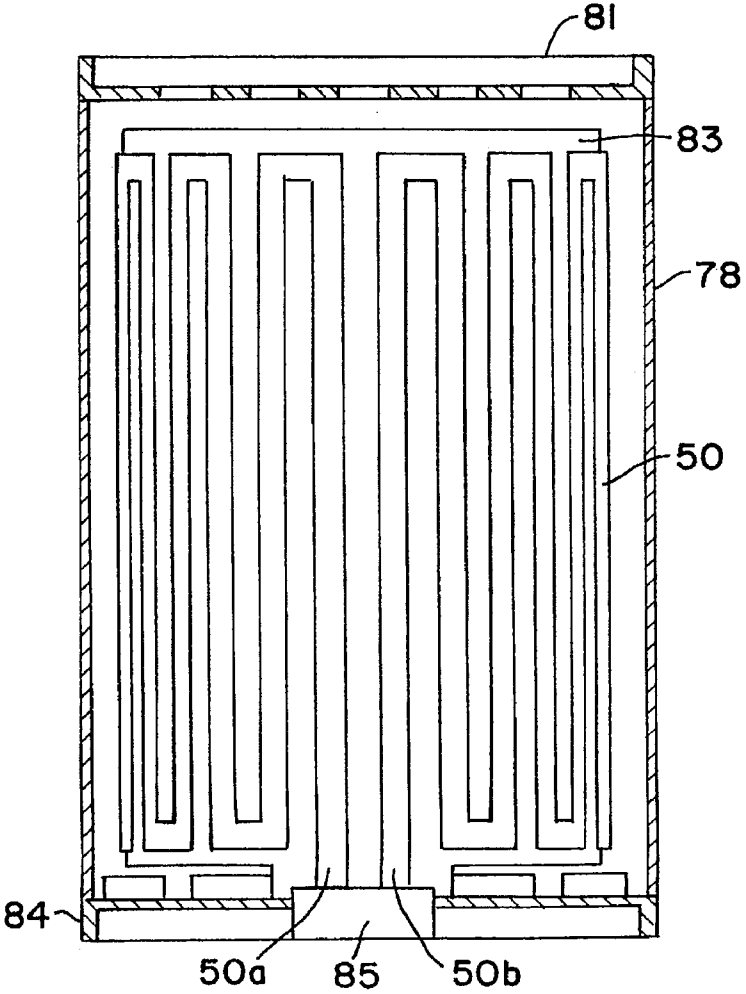
FIGS. 6A and 6B are two comparable views of an alternative form of a space heater constructed in accordance with the principles of our invention, with FIG. 6A being a perspective view, shown partially broken away, and FIG. 6B being a cross-sectional view taken along line 6B—6B in FIG. 6A.
Figure 6A:
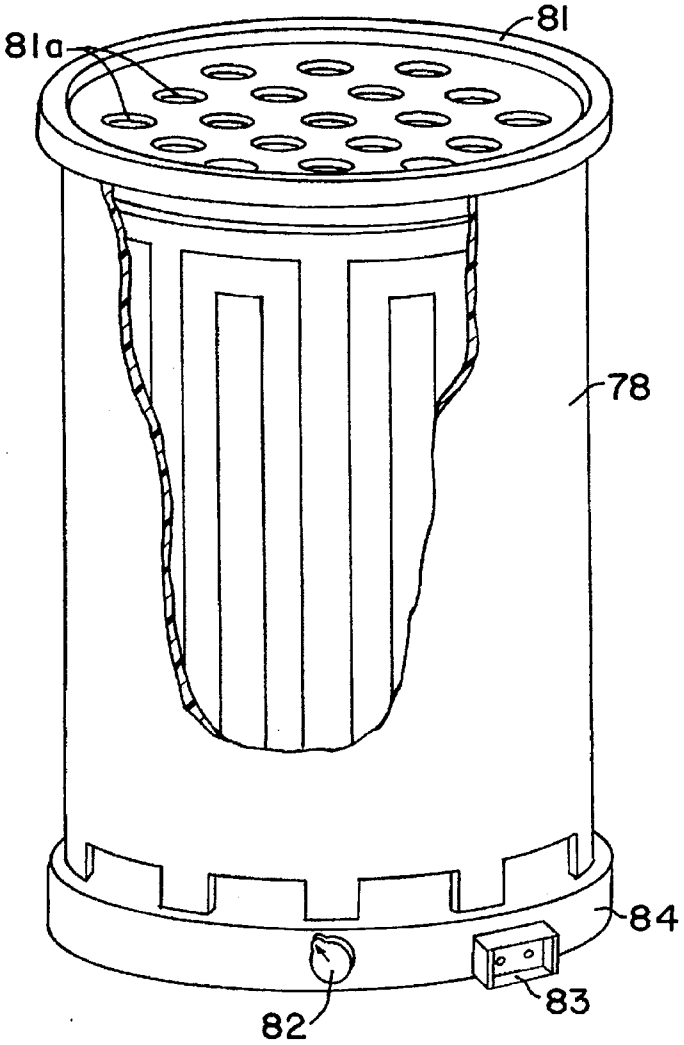

The space heater of FIGS. 6A and 6B is similar to that of FIGS. 5A and 5B with one major difference. This tower-shaped heater includes the same cover 81 with holes **81*a*, radiating cover 78, and base 84 with a control knob 82 and a plug socket 83. But instead of an amorphous metallic ribbon 80 being wound around insulating rods 79, the heater of FIGS. 6A and 6B includes a heating element of the type shown in FIGS. 2A–2C, although obviously the heating element used for a space heater would be larger than that used for the hair dryer of FIG. 3. The ribbon 50, supported on a single plastic sheet 83, is shown in the cross-sectional view of FIG. 6B, with the two ends, 50*a*, 50*b* of the ribbon terminating in a central block 85**. From the block the ends of the ribbon are coupled through the regulating mechanism to the socket.

Figure 7B:
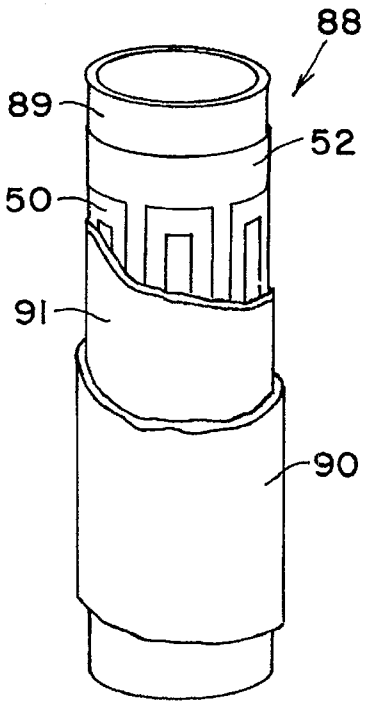
FIG. 7B is a detailed view of the heating element.
Figure 7A:
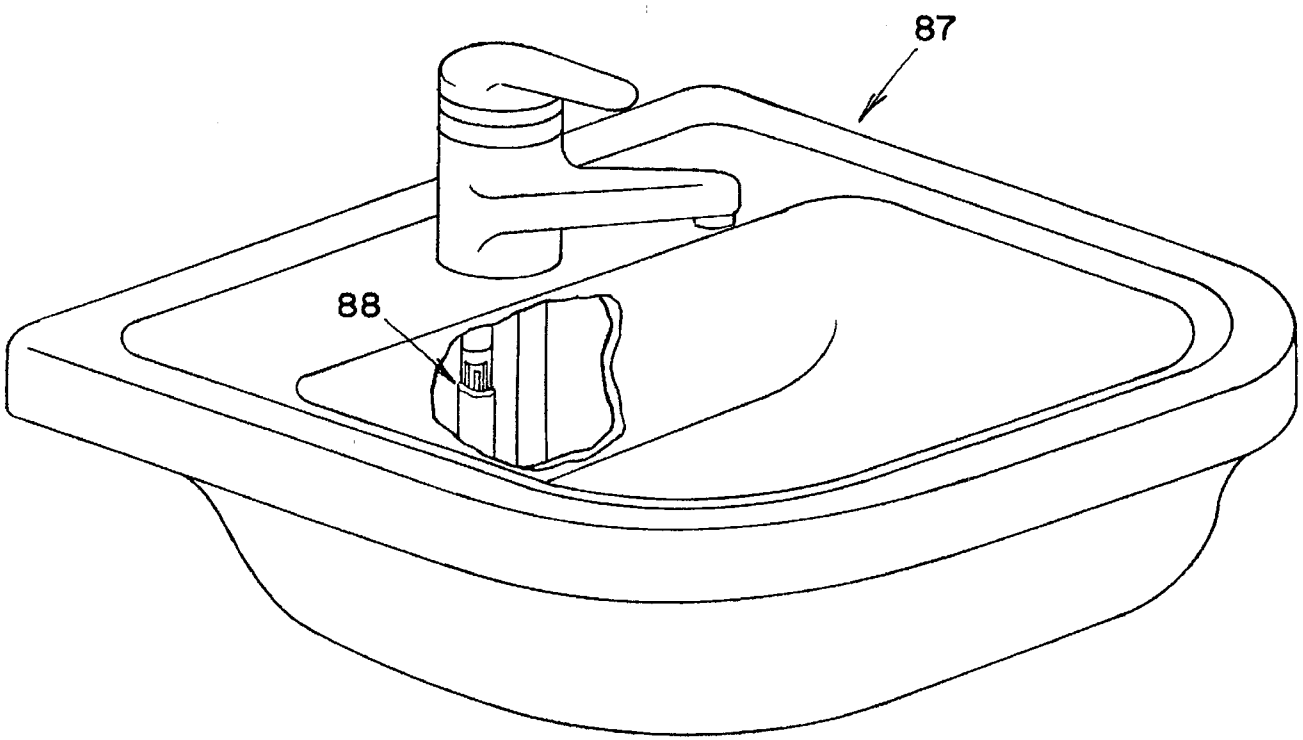
FIG. 7A depicts a conventional sink with a water heating element 88 constructed in accordance with the principles of our invention.

FIGS. 7A and 7B depict an unusual use for the heating element of our invention. FIG. 7A shows a conventional sink 87 with part of the hot water pipe being replaced by a heating element 88, shown in greater detail in FIG. 7B. The overall heating element consists of a copper pipe 89 through which cold water flows from the bottom and hot water exits from the top, a 0.2-mm thick layer of silicon insulation 52, a ribbon layer 50 mounted on a plastic carrier 91 glued to layer 52, and a 2.4-mm thick layer of mineral thermal insulation 90.

In one embodiment of the invention of FIGS. 7A and 7B, the water flow rate was 2 kg/mm, the input temperature of the water was 15°–20° C., and the output temperature, at the top of the pipe, was 55°–60° C. The pipe 89 had an inner diameter of 32 mm, an outer diameter of 36 mm, and a length of 0.5 m. Three ribbons were connected electrically in parallel and wound around the pipe. Each ribbon was 25 microns thick, 5 mm wide, and 3 m long, for a total mass of 8 grams. The ribbon material was $Fe_{78}B_{18}Si_4$. When placed across a 220-volt line, about 8.5 amperes flowed through each ribbon for a total power level of 5.6 kilowatts. The temperature of the ribbon was measured at 180° C., and the hot water heater was operated for 200 hours with no complications.

Parallel connection of the heating ribbons is equivalent to using a wider ribbon. As is known in the art, parallel connection of three ribbons reduces the total electrical resistance three times; thus, for the same electrical resistance, each ribbon has to be three times as long as well. In comparison to ribbons known in the art as detailed in JP2-112192, the device in the present invention has an area nine times larger, thus operating at a temperature about nine times lower.

Figure 8B:
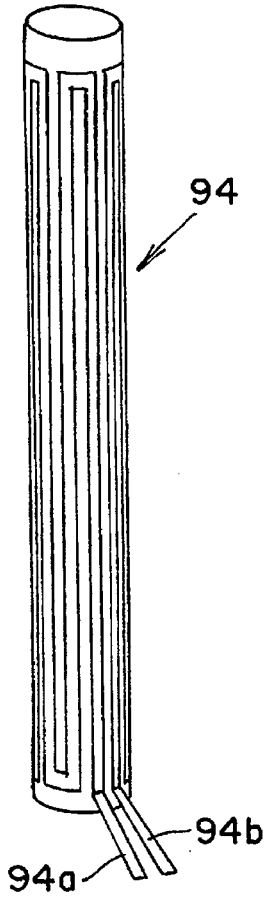
FIGS. 8A and 8B are comparable views of an alternative form of a water heating element constructed in accordance with the principles of our invention.
Figure 8A:
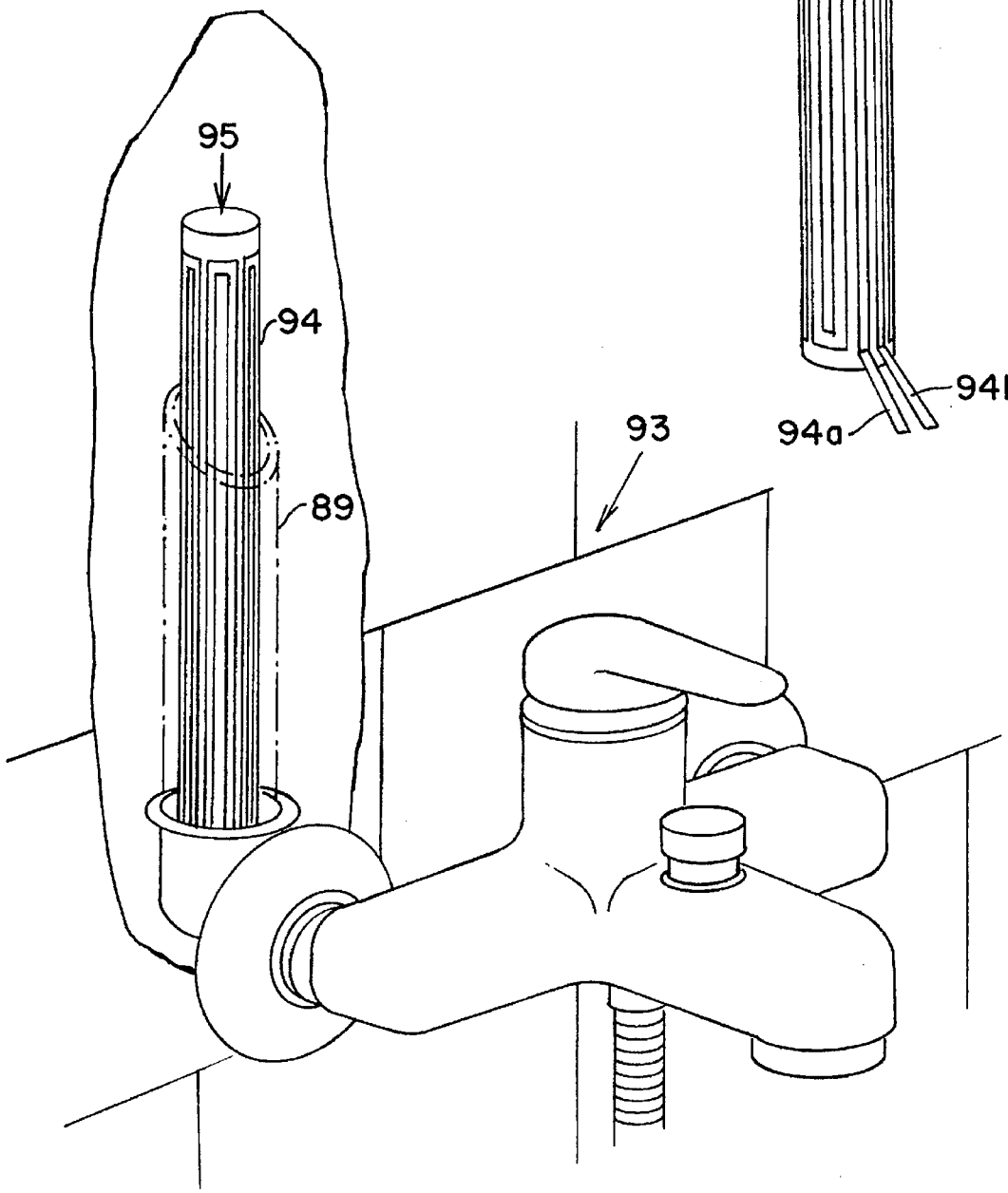

FIGS. 8A and 8B are similar to FIGS. 7A and 7B, and depict an alternative mechanism for heating water as it flows through a conventional pipe. Here, the heating element laminate 94 is shown in FIG. 8B, and is of the type depicted in FIGS. 2A–2C. (The terminations of the ends 94*a*, 94*b* of the heating ribbon are not shown, but it is to be understood that the ends of the ribbon are connected through an appropriate switch to line power, the switch being turned on when hot water is desired.) The heating element 94 is placed inside the pipe 89, and water flows inside and around the heating element as symbolized by arrow 95 in FIG. 8A. (It is of course important that the ends of the heating element which extend out of the laminate also be similarly insulated so that they are not shorted by the flowing water.) Instead of heating the pipe as in FIGS. 7A and 7B, the embodiment of the invention shown in FIGS. 8A and 8B utilizes a heating element which heats the water directly.

Although the invention has been described with reference to particular embodiments, it is to be understood that these embodiments are merely illustrative of the application of the principles of the invention. Numerous modifications may be made therein and other arrangements may be devised without departing from the spirit and scope of the invention.

What we claim is:

1. An electric heater element, comprising:

a ribbon of amorphous metallic alloy, the alloy having an embrittlement temperature, the ribbon having an electrical resistance according to the desired electrical power to be converted into heat power and the mains voltage, the ribbon defining a shape and a size for enabling a thermal resistance required to deliver the heat power to the surroundings with the element being at an operating temperature that is below the embrittlement temperature of the alloy, the ribbon comprising an overheated metallic alloy ribbon.

2. The electric heater element of claim 1, wherein the element has an operating temperature below about 300 degrees Celsius.

3. The electric heater element of claim 1, wherein the element has an operating temperature between about 50 and 200 degrees Celsius.

4. The electric heater element of claim 1, wherein the element has an operating temperature below about 180 degrees Celsius.

5. The electric heater element of claim 1, wherein the element has an operating temperature of about 150 degrees Celsius.

6. The electric heater element of claim 1, wherein the element has an operating temperature below the formation temperature of benzopyrene.

7. The electric heater element of claim 1, wherein the ribbon comprises a substantially planar ribbon having a thickness of less than 100 microns.

8. The electric heater element of claim 7, wherein the element has an operating temperature below the temperature of formation of benzopyrene.

9. The electric heater element of claim 7, wherein the element has an operating temperature below about 180 degrees Celsius.

10. The electric heater element of claim 7, wherein the element has an operating temperature between about 50–20 degrees Celsius.

11. The electric heater element of claim 1, wherein the ribbon comprises an alloy of at least one of $Fe_{78}B_{18}Si_4$, $Fe_{74}Co_{2.5}Cr_{7.5}B_{16}$, $Fe_{13}Ni_{60}Cr_5Si_{10}B_{12}$ and $Al_{65}Co_{10}Ge_{25}$.

12. The electric heater element of claim 1, wherein the alloy comprises:

at least one of iron, nickel and cobalt in an amount of between about 65–88 molar percent, at least one of boron, silicon and phosphorus in an amount of between about 12–28 molar percent, and chromium in an amount of between about 0–11 molar percent.

13. An electrical heating system comprising:

at least one electric heater element comprising an amorphous metallic alloy ribbon, the ribbon having an electrical resistance according to the desired electrical power to be converted into heat power, the ribbon having a shape and size such as to achieve the thermal resistance required to deliver the heat power with the element being at an operating temperature that is below the embrittlement temperature of the alloy, the ribbon comprising an overheated metallic alloy ribbon, electrical insulation means for covering the ribbon to prevent electrical shock while transferring heat power, the insulation means comprising materials capable of operation at temperatures in the range of the operating temperature, and support means for mechanically holding the ribbon in the heating system, the support means comprising a material capable of operation at a temperature in the range of the operating temperature of the element.

14. The electrical heating system of claim 13, wherein the insulation comprises a plastic laminate covering the ribbon.

15. The electrical heating system of claim 14, wherein the plastic laminate comprises at least one of polystyrene, polyamide and silicon.

16. The electrical heating system of claim 14, wherein the support comprises silicone glue for attaching the electric heater elements and the support means.

17. The electric heater element of claim 14, wherein the element has an operating temperature between about 50 and 200 degrees Celsius.

* * * * *

UNITED STATES PATENT AND TRADEMARK OFFICE

CERTIFICATE OF CORRECTION

PATENT NO. : 5,641,421

DATED : June 24, 1997

INVENTOR(S) : Vladimir Manov, et. al.

It is certified that error appears in the above-identified patent and that said Letters Patent is hereby corrected as shown below:

Title page, item [73], Assignee: insert --Advanced Metal Technologies Ltd., Even Yehuda, Israel--.

Signed and Sealed this

Second Day of June, 1998

*Attest:*

Bruce Lehman

BRUCE LEHMAN

*Attesting Officer*

*Commissioner of Patents and Trademarks*